United States Patent [19]

Dempsey

[11] Patent Number: 4,662,778

[45] **Date of Patent: * May 5, 1987**

[54] DRAINAGE MAT

[75] Inventor: Barry J. Dempsey, White Heath, Ill.

[73] Assignee: Monsanto Company, St. Louis, Mo.

[ * ] Notice: The portion of the term of this patent subsequent to Feb. 25, 2003 has been disclaimed.

[21] Appl. No.: 480,657

[22] Filed: Mar. 31, 1983

[51] Int. Cl.[4] ..... E01C 5/20

[52] U.S. Cl. ..... 404/35; 404/44; 405/50; 428/86; 428/95; 52/169.5; 210/484; 210/486; 210/170

[58] Field of Search ..... 404/35, 36, 44, 64, 404/66, 67, 69; 405/45, 50, 24; 52/169.5; 210/507, 508, 505, 458, 483, 486, 487, 170; 428/17, 86, 95

[56] References Cited

U.S. PATENT DOCUMENTS

| | | | |
|---|---|---|---|
| 2,076,980 | 4/1937 | Cooper | 210/505 X |
| 2,945,557 | 7/1960 | Powers | 210/507 |
| 3,323,310 | 6/1967 | Arpin | 405/24 |
| 3,507,010 | 4/1970 | Doleman et al. | 425/134 |
| 3,563,038 | 2/1971 | Healy et al. | 61/11 |
| 3,573,142 | 3/1971 | Chidgey et al. | 428/17 |
| 3,654,765 | 4/1972 | Healy et al. | 61/11 |
| 3,765,783 | 10/1973 | Wager | 404/2 |
| 3,830,373 | 8/1974 | Sixt et al. | 210/489 |
| 3,965,686 | 6/1976 | Saito et al. | 52/169.5 X |
| 4,057,500 | 11/1977 | Wager | 210/170 |
| 4,182,581 | 1/1980 | Uehara et al. | 405/43 |
| 4,288,321 | 9/1981 | Beane | 405/45 X |
| 4,309,855 | 1/1982 | Pate et al. | 405/45 X |

FOREIGN PATENT DOCUMENTS

| | | | |
|---|---|---|---|
| 893615 | 10/1982 | Belgium . | |
| 023871 | 2/1981 | European Pat. Off. . | |
| 7811388 | 5/1980 | Netherlands | 405/50 |
| 2040655 | 9/1980 | United Kingdom | 405/50 |
| 2102041 | 1/1983 | United Kingdom . | |

OTHER PUBLICATIONS

Dempsey, B. J., "Climatic Effects on Airport Pavement Systems State of the Art", Report No. FAA-RD-75-196 (NTIS No. AD/A-029, 422), Jun. 1976.

Copeland, J. A., "Fabrics in Subdrains: Mechanisms of Filtration and the Measurement of Permeability", Transportation Research Report 80-2, Jan. 1980, pp. 97-104.

Mitsui Petrochemical Industries—Product Bulletin: "CULDRAIN".

Nylex Product Bulletins: "STRIPDRAIN" and CORDRAIN.

American Enka Company—Product Bulletin: "ENKADRAIN".

Civil Engineering, Suppl. Mar. 1981, London "The Trammel Drainage System" pp. 24-26, (p. 25).

Civel Engineering—A SCE, vol. 46, No. 3, Mr. 1976, "Plastic Filter Fabrics . . . " pp. 57-59, (p. 58).

*Primary Examiner*—Stephen J. Novosad
*Assistant Examiner*—John F. Letchford
*Attorney, Agent, or Firm*—Thomas E. Kelley

[57] ABSTRACT

Drainage mat comprising three-dimensional openwork covered on at least a major surface with a water permeable fabric having a permittivity from 0.2 seconds$^{-1}$ to 2.0 seconds$^{-1}$ and exhibiting a dynamic permeability after $10^6$ loadings of at least $10^{-4}$ centimeters per second.

6 Claims, 8 Drawing Figures

DRAINAGE MAT

BACKGROUND OF THE INVENTION

This invention relates to multidirectional drainage mats which are useful and effective, for instance as a highway edge drain for the dewatering of highway pavement systems.

The problem of water in pavements has been of concern to engineers for a considerable period of time. As early as 1823 McAdam reported to the London (England) Board of Agriculture on the importance of keeping the pavement subgrade dry in order to carry heavy loads without distress. He discussed the importance of maintaining an impermeable surface over the subgrade in order to keep water out of the subgrade.

The types of pavement distresses caused by water are quite numerous. Smith et.al. in the "Highway Pavement Distress Identification Manual" (1979) prepared for the Federal Highway Administration of the U.S. Department of Transportation identifies most of the common types of distresses.

Moisture in pavement systems can come from several sources. Moisture may permeate the sides, particularly where coarse-grained layers are present or where surface drainage facilities within the vicinity are inadequate. The water table may rise; this can be expected in the winter and spring seasons. Surface water may enter joints and cracks in the pavement, penetrate at the edges of the surfacing, or percolate through the surfacing and shoulders. Water may move vertically in capillaries or interconnected water films. Moisture may move in vapor form, depending upon adequate temperature gradients and air void space. Moreover, the problem of water in pavement systems often becomes more severe in areas where frost action or freeze-thaw cycles occur, as well as in areas of swelling soils and shales.

The types of pavement distresses caused by water are quite numerous and vary depending on the type of pavement system. For flexible pavement systems some of the distresses related to water either alone or in combination with temperature include: potholes, loss of aggregates, raveling, weathering, alligator cracking, reflective cracking, shrinkage cracking, shoving, and heaves (from frost or swelling soils). For rigid pavement systems, some of the distresses include faulting, joint failure, pumping, corner cracking, diagonal cracking, transverse cracking, longitudinal cracking, shrinkage cracking, blowup or buckling, curling, D-cracking, surface spalling, steel corrosion and heaving (from frost or swelling soils).

Similar types of distresses occur in taxiways and runways of airfields.

Numerous of these joint and slab distresses are related to water pumping and erosion of pavement base materials used in rigid pavement construction. Water pumping and erosion of pavement base materials have been observed to cause detrimental effects on shoulder performance as well. Also, many of the distresses observed in asphalt concrete pavements are caused or accelerated by water.

For instance, faulting at the transverse joints is a normal manifestation of distress of unreinforced concrete pavements without load transfer. Faulting can occur under the following conditions:

1. The pavement slab must have a slight curl with the individual slab ends raised slightly off the underlying stabilized layer (thermal gradients and differential drying within the slab create this condition).

2. Free water must be present.

3. Heavy loads must cross the transverse joints first depressing the approach side of the joint, then allowing a sudden rebound, while instantaneously impacting the leave side of the joint causing a violent pumping action of free water.

4. Pumpable fines must be present (untreated base material, the surface of the stabilized base or subgrade, and foreign material entering the joints can be classified as pumpable fines).

Faulting of ¼ in. or more adversely affected the riding quality of the pavement system.

Methods for predicting and controlling water contents in pavement systems are well documented by Dempsey in "Climatic Effects on Airport Pavement Systems—State of the Art", Report No. FAA-RD-75-196 (1976), U.S. Department of Defense and U.S. Department of Transportation. Methods for controlling moisture in pavement systems can generally be classified in terms of protection through the use of waterproofing membranes and anticapillary courses, the utilization of materials which are insensitive to moisture changes, and water evacuation by means of subdrainage.

Field investigations indicate that evacuation by means of a subdrainage system is often the preferred method for controlling water in pavement systems. In this regard proper selection, design, and construction of the subdrainage system is important to the long-term performance of a pavement. A highway subsurface drainage system should, among other functions, intercept or cut off the seepage above an impervious boundary, draw down or lower the water table, and/or collect the flow from other drainage systems.

Existing highway drains include a multitude of designs. Among the simplest are those which comprise a perforated pipe installed at the bottom of an excavated trench backfilled with sand or coarse aggregate. For instance, a standard drain specified by the State of Illinois requires a 4-inch diameter perforated pipe be placed in the bottom of a trench 8 inches (20.3 cm) wide by 30 inches (76 cm) deep. The trench is then backfilled with coarse sand meeting the State of Illinois standard FA1 or FA2. Such drains are costly to fabricate in terms of labor and materials. For instance the material excavated from the trench must be hauled to a disposal site, and sand backfill must be purchased and hauled to the drain construction site.

Other types of drains have attempted to avoid the use of the perforated pipe by utilizing a synthetic textile fabric as a trench liner. The fabric lined trench is filled with a coarse aggregate which provides a support for the fabric. The void space within the combined aggregate serves as a conduit for collected water which permeates the fabric. Such drains are costly to install, for instance in terms of labor to lay in and fold the fabric as well as in terms of haulage of excavated and backfill material. Moreover, there is considerable fabric area blocked by contact with the aggregate surface. This results in an increased hydraulic resistance through the fabric areas contacting the aggregate surface.

Other modifications to drainage material include fabric covered perforated conduit, such as corrugated pipe as disclosed by Sixt et.al. in U.S. Pat. No. 3,830,373 or raised surface pipe as disclosed by Uehara et.al. in U.S. Pat. No. 4,182,581. A disadvantage is that the planar surface area available for intercepting subsurface water is limited to approximately the pipe diameter unless the fabric covered perforated conduit is installed at the bottom of an interceptor trench filled, say, with coarse sand. A further disadvantage is that much of the fabric surface, say about 50 percent, is in contact with the conduit, thereby reducing the effective collection area.

The problem of limited planar surface area for intercepting subsurface water is addressed by drainage products disclosed by Healy et.al. in U.S. Pat. Nos. 3,563,038 and 3,654,765. Healy et.al. generally disclose a planar extended surface core covered with a filter fabric which serves as a water collector. One edge of the core terminates in an pipe-like conduit for transporting collected water. Among the configurations for the planar extended core are a square-corrugated sheet and an expanded metal sheet. A major disadvantage of designs proposed by Healy et.al. is that the drains are rigid and not bendable; this requires excavation of sufficiently long trenches that an entire length of drain can be installed. The pipe-like conduit requires a wider trench than might otherwise be needed. Moreover, the expanded metal sheet core does not provide adequate support to the fabric which can readily collapse against the opposing fabric surface, thereby greatly reducing the flow capacity within the core. Also the square corrugated sheet core is limited in that at least 50 percent of the fabric surface arc is occluded by the core, thereby reducing water collection area.

A related drainage material with extended surface is a two-layer composite of polyester non-woven filter fabric heat bonded to an expanded nylon non-woven matting such as ENKADRAIN TM foundation drainage material available from American Enka Company of Enka, N.C. The drainage material which can be rolled has filter fabric on one side of the nylon non-woven matting. The drainage material serves as a collector only and requires installation of a conduit at the lower edge. This necessitates costly excavation of wide trenches, in addition to cost of conduit.

Another related drainage material with extended surface comprises a filter fabric covered core of cuspated polymeric sheet, such as STRIPDRAIN drainage product available from Nylex Corporation Limited of Victoria, Australia. The impervious cuspated polymeric sheet divides the core into two isolated opposing sections which keeps water collected on one side on that side. Moreover, in order that the drainage material be flexible, the core must be contained in a loose fabric envelope, which being unsupported on the core can collapse due to soil loading into the core thereby blocking flow channels. The cuspated polymeric sheet is bendable only along two perpendicular axes in the plane of the sheet. This makes installation somewhat difficult, for instance whole lengths must be inserted at once in an excavated trench.

A still further similar polymeric drainage product comprises a perforated sheet attached to flat surfaces of truncated cones extending from an impervious sheet, such as CULDRAIN board-shaped draining material available from Mitsui Petrochemical Industries, Ltd. The perforated sheet has holes in the range of 0.5 to 2.0 millimeters in diameter and allows fine and small particles to be leached from the subsurface soil.

The drainage materials available have one or more significant disadvantages, including economic disadvantages of requiring extensive amounts of labor for installation and performance disadvantages such as requiring separate conduit for removing collected water. A further performance disadvantage is that the drainage materials utilize fabric which, depending on the adjoining soil, may become blinded with soil particles or may allow too much material to pass through resulting in loss of subgrade support.

This invention overcomes most if not all of the major disadvantages of engineering fabric utilized in previously known drainage materials.

Among the useful parameters for characterizing fabric useful in the drainage mat of this invention is the coefficient of permeability which indicates the rate of water flow through a fabric material under a differential pressure between the two fabric surfaces expressed in terms of velocity, e.g., centimeters per second. Such coefficients of permeabiity can be determined in accordance with American Society for Testing and Materials (ASTM) Standard D-737. Because of difficulties in determining the thickness of a fabric for use in determining a coefficient of permeability, it is often more convenient and meaningful to characterize fabric in terms of permittivity which is a ratio of the coefficient of permeability to fabric thickness, expressed in terms of velocity per thickness, which reduces to inverse time, e.g., seconds$^{-1}$. Permittivity can be determined in accordance with a procedure defined in Appendix A of Transportation Research Report 80-2, available from the U.S. Department of Transportation, Federal Highway Administration.

Engineering fabrics used with drainage mats can be quite effective in protecting soil from erosion while permitting water to pass through the fabric to the conduit part of the drainage mat. However, the fabric must not clog or in any way significantly decrease the rate of flow. At the same time the fabric must not let too much material pass through, or clogging of the drainage mat could occur. However, loss of subgrade support could also occur.

When considering the actual soil-filter fabric interaction, a rather complex bridging or arching occurs in the soil next to the fabric that permits particles much smaller than the openings in the fabric to be retained. Failure of the soil-fabric system can result from either excessive piping of soil particles through the fabric or from substantial decrease in permeability through the fabric and adjacent soil.

The use of engineering fabrics in highway drainage mats requires the consideration of an additional factor. A highway is subjected to repeated dynamic loading by traffic. Such loading can lead to substantial pore pressure pulses in a saturated pavement system. During and after heavy rain a soil-filter fabric at the pavement edge may be subjected not only to a static hydraulic gradient, but also to a dymanic gradient caused by the highway traffic loading.

In this regard another useful parameter for characterizing fabric useful in the drainage mat of this invention is "dynamic permeability" which indicates the rate of water flow through a column of specifically gradated soil over a layer of fabric material under a combined static and dynamic hydraulic gradient. "Dynamic permeability" characterizes fabric performance in resisting blinding and pluggage under conditions which duplicate the effects of repeated traffic loading. The method for determining "dynamic permeability" is disclosed in Example II, herein.

SUMMARY OF THE INVENTION

This invention provides a drainage mat comprising a three-dimensional openwork covered on at least a major surface with a water permeable fabric, having a permittivity from 0.2 seconds$^{-1}$ to 2.0 seconds$^{-1}$ and exhibiting a dymanic permeability after $10^6$ loadings of at least $10^{-4}$ centimeters per second.

DESCRIPTION OF THE PREFERRED EMBODIMENTS

The drainage mat of this invention comprises a three-dimensional openwork covered on at least a major surface with a water permeable fabric. A drainage mat is generally planar shaped with its thickness being substantially smaller than its other dimensions. The dimensions of the drainage mat correspond closely to the dimensions of the three-dimensional openwork, which provides support for the fabric and has a substantial void volume to allow for multi-direction water flow within the open work.

Figure 1:
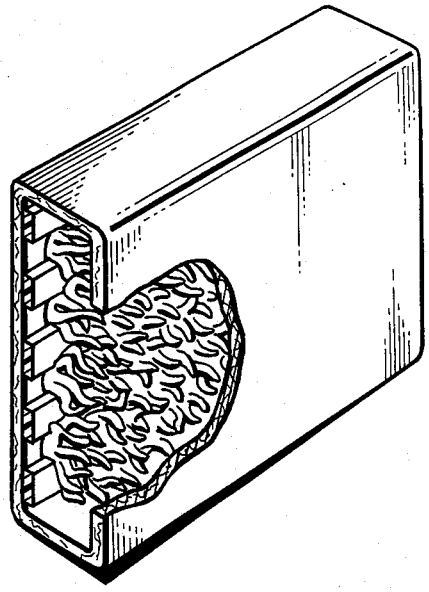
FIG. 1 schematically illustrates an embodiment of the drainage mat of this invention.
Figure 2:
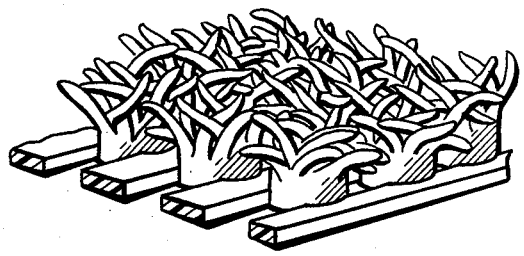
FIG. 2 schematically illustrates a synthetic grass-like material useful as the three-dimensional openwork of the drainage mat of this invention.

The openwork can comprise a variety of configurations and materials. A useful configuration for some applications is a synthetic grass-like material as described by Doleman et.al. in U.S. Pat. No. 3,507,010, incorporated herein by reference. In this regard FIG. 1 schematically illustrates such a drainage mat where fabric envelops a synthetic grass-like material. FIG. 2 illustrates such synthetic grass-like material. Other configurations include any of those planar-shaped openworks known in the art which do not block substantial areas of the fabric covering.

Useful materials for openwork include polymeric materials such as polyethylene, polypropylene, polyamides, polyesters and polyacrylonitriles. It has been found that hydrophobic materials, such as polyethylene, are generally preferred to hydrophillic materials, such as polyamides. Fine particles which wash through the fabric may contain charges or have some other chemical or electro-chemical affinity, for hydrophillic materials, resulting in material buildup, and possible pluggage, within the openwork.

Polymeric materials are generally preferred since they are lightweight, easy to handle and fabricate and are generally environmentally resistant. However, depending on the application, other materials could be used, for instance metal, such as aluminum expanded metal sheet.

The enveloping water permeable fabric can comprise a wide variety of materials. Among the preferred fabrics are those made from polymeric materials such as polyethylene, polypropylene, polyamides, polyesters and polyacrylics. In most instances it is preferred that the fabric comprise a hydrophobic material such as polypropylene or polyester. Such fabric should be sufficiently water permeable that it exhibits a water permittivity in the range of from about 0.2 seconds$^{-1}$ to 2.0 seconds$^{-1}$. More preferred fabrics are those having a permittivity in the range of from about 0.5 seconds$^{-1}$ to about 1.0 seconds$^{-1}$. The fabric can either be of a woven or non-woven manufacture; however non-woven fabrics are often generally preferred.

Such permittivity indicates that the fabric allows adequate water flow through the fabric to the conduit part of the drainage mat. Such water flow is not so great as to allow so much suspended material to pass through the fabric that would result either in loss of subgrade support or clogging of the drainage mat.

The fabric should also exhibit substantial resistance to blinding and pluggage, for instance as may be caused by bridging or arching of soil particles next to the fabric. Since the fabric in many installations, for instance in highway edge drains, is subjected to both static and dynamic hydraulic gradient due to repeated traffic loading, dynamic permeability is an essential characteristic of the drainage mat of this invention. In general, the fabric should exhibit a dynamic permeability after $10^6$ loadings, as described in the procedure of Example II below, of at least $10^{-4}$ centimeters per second. A more preferred fabric will exhibit a dynamic permeability after $10^6$ loadings of at least $10^{-3}$ centimeters per second, for instance in the range of $10^{-2}$ to $10^{-3}$ centimeters per second. In some instances, a fabric which exhibits a dynamic permeability of as low as $10^{-5}$ centimeters per second may be acceptable.

Dynamic permeability readings may vary over the course of repeated loadings, for instance over $10^6$ loadings. It is generally desired that variations in dynamic permeability be within an acceptable range based on the highest reading of dynamic permeability. For instance, the ratio of the highest reading of dynamic permeability to the lowest reading of dynamic permeability over $10^6$ loadings (a million loading dynamic permeability ratio) should not exceed 100. It is more preferred that the million loading dynamic permeability ratio be about 50 or less.

The water permeable fabric need not envelop the entire openwork. The fabric should however totally cover at least a major surface which is intended to intercept ground water.

The drainage mat of this invention is useful in any number of applications where it is desirable to remove water from an area. It is particularly useful in subsurface applications where ground water removal is desired.

A large surface area available for drainage is provided by the rectangular transverse cross-section of the drainage mat. This is particularly advantageous in those installations where the drainage mat is installed such that the larger of its transverse cross-sectional dimensions is normal to the surface of an area to be drained. Such an advantageous installation is in a highway system where the drainage mat is installed parallel to a road for instance in a vertical orientation under a highway shoulder joint. In such an installation water infiltrating in a vertical direction through the highway shoulder joint can be intercepted by the narrow transverse cross-sectional area at the top of the drainage mat and water present under the highway can be intercepted by the large transverse cross-sectional area which is normal to the highway support bed, and the opposing large transverse cross-sectional area can intercept ground water approaching the highway from the outside. All such intercepted water can be carried away as soon as it is collected by the drainage mat.

In other installations where it is desired to maintain a moisture level in a highway support bed, a drainage mat with an impervious layer can be installed with the impervious layer in contact with the vertical edge of the support bed preventing flow of water either into or out of the support bed. The drainage mat can intercept and carry away water which could otherwise enter the support bed.

This invention is further illustrated by, but not limited to, the following examples.

EXAMPLE I

Three varieties of engineering fabric were obtained. These three fabrics and their equivalent opening size (the equivalent U.S. Sieve No, as determined by Test Method CW-02215) are identified in Table 1. The three fabrics were subjected to permittivity analysis. The results of the permittivity analysis based on ten random specimens for each fabric and ten test runs on each specimen are shown in Table 2.

TABLE 1

| Fabric No. | Description | Equivalent Opening Size |
|---|---|---|
| 1. | Non-woven spunbonded polypropylene fabric, obtained from E. I. duPont de Nemours & Co. as TYPAR ® spunbonded polypropylene, Style 3601 | 140–170 |
| 2. | Woven polypropylene fabric, obtained from Advanced Construction Specialties Company designated as Type II | 35 |
| 3. | Non-woven polypropylene fabric, obtained from Amoco Fabrics Company, as PROPEX 4545 Soil Filtration Fabric, calendered | 75 (minimum) |

TABLE 2

| Fabric No. | Permittivity |
|---|---|
| 1. | 0.094 seconds$^{-1}$ |
| 2. | 1.80 seconds$^{-1}$ |
| 3. | 0.75 seconds$^{-1}$ |

EXAMPLE II

This example illustrates the test procedure for determining "dynamic permeability" of a fabric. The three varieties of engineering fabric identified in Example I were subjected to "dynamic permeability" analysis using the triaxial cell apparatus schematically illustrated in FIG. 3. The triaxial cell apparatus comprises a metal base plate 1, having a central raised boss 4 of 8 inches (20 cm) in diameter and an annular groove to accept cylinder 2. The metal base plate has a fluid port from the center of the raised boss 4 to the periphery. A flexible outer confining membrane 3 of 1/32 inch (0.8 mm) thick neoprene rubber is secured to the periphery of the central raised boss 4. Silicone grease is applied to the interface of the outer confining membrane and the central raised boss to provide a water tight seal. A porous carborundum stone 5, 8 inches (20 cm) in diameter, is placed on the central raised boss 4. Four perforated rigid plastic discs 6, 8 inches (20 cm) in diameter, are placed on carborundum stone 5. A piezometric pressure tap tubing 7 is installed in a hole in the outer confining membrane 3, just below the top of the plastic discs 6. A single layer of glass spheres 8, 0.625 inch (1.5 cm) in diameter, is placed on the top plastic disc.

A flexible inner membrane 9, having 8 inches (20 cm) diameter engineering fabric disc 10 secured to the bottom edge of flexible inner membrane 9, is inserted within the flexible outer membrane 3, such that the engineering fabric disc 10 rests on the layer of glass spheres 8. A coating of silicone grease at the interface of flexible inner membrane 9 and flexible outer membrane 3 provides a water tight seal between the two membranes.

Water is allowed to flow into the confining membrane 3 from the port in the base plate to a level above the fabric disc to remove any trapped air. The water is then drained to the level of the fabric disc 10.

Figure 5:
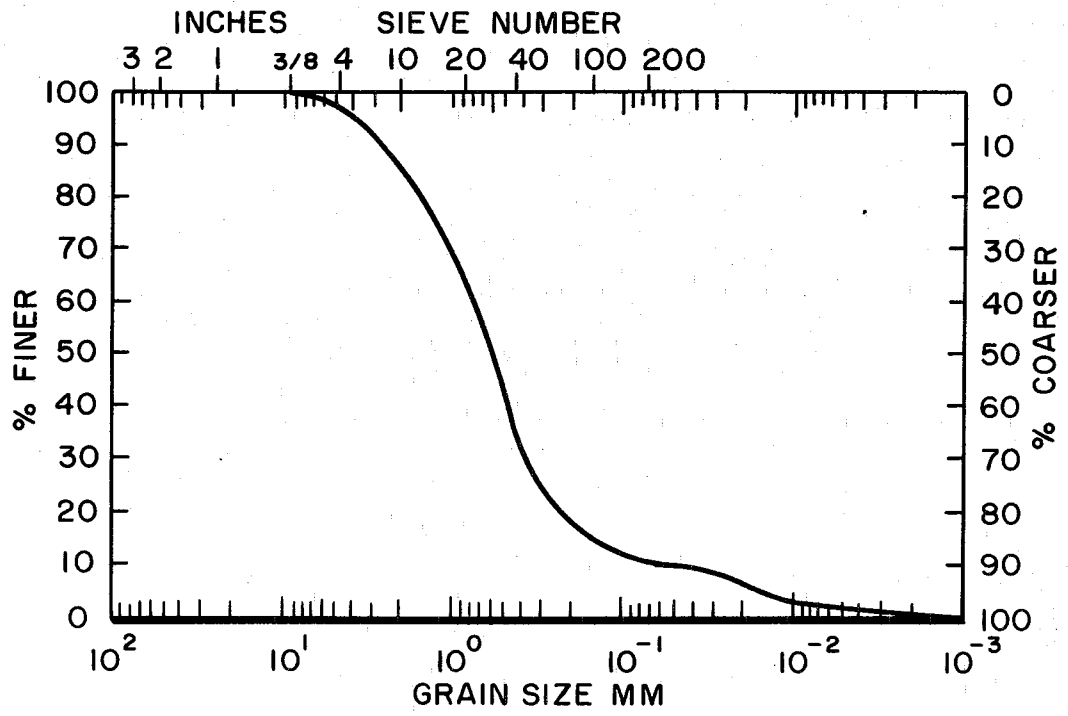
FIG. 5 is a plot of particle size analysis of a soil mixture used in determining dynamic permeability.

A dry soil mixture of 90 percent by weight Class X concrete sand (no minus number 200 sieve material) and 10 percent by weight Roxana silt is prepared. The dry soil has a gradation analysis as shown in FIG. 5. 30 pounds (13.6 kg) of dry soil is thoroughly mixed with 2 liters of water to produce a mixture at close to 100 percent water saturation. The mixture M is loaded into the flexible inner membrane 9 to a height of about 9.4 inches (24 cm) above the fabric disc 10. As the mixture M is loaded into the membrane, excess water is allowed to drain from mixture M by maintaining the open end of tubing 7 at a level about 0.4 inch (1 cm) above the fabric disc 10.

After all excess water has drained from the mixture M, a porous carborundum stone 11, 20 cm (8 inches) in diameter, is placed on the mixture M. A metal cap 12, 8 inches (20 cm) in diameter, is placed over the stone 11. Silicone grease is applied to the interface between the cap 12 and the flexible inner membrane 9. Bands (not shown) are used to secure the membranes to the cap 12. The cap 12 has two ports and a raised center boss. A transparent cylinder 2 is placed over the assembly with the bottom edge of the cylinder 2 fitting into the annular groove of the base 1. A metal cell top 13 is placed over the cylinder 2 with the top edge of the cylinder fitting into an annular groove in the cell top 13. The cell top 13 and the base plate 1 are held against the cylinder 2 by bolts (not shown).

The cell top 13 has four ports—one port is connected to tubing 14 which provides cell pressurizing water; another port is connected to tubing 15 which runs through the cell top 13 to a port on the cap 12 which can be used to provide flush water to the confined mixture M; another port is connected to tubing 16 which runs through the cell top 13 to a port on the cap 12 which provides water flow for analysis; the fourth port is connected to tubing 7 which is used to monitor pressure below the fabric disc 10. The cell top 13 has a bore through the raised boss 17. The bore allows loading rod 18 to pass through the cell top 13 to the top of metal cap 12. The bottom surface of the loading rod 18 and the top surface of the metal cap 12 have spherical indentations to receive metal sphere 19 which allows a point load to be transmitted. O-rings (not shown) provide a seal between the loading rod 18 and the bore through the cell top 13.

The triaxial cell apparatus is prepared for operation by filling the annular space between the cylinder 2 and the membranes with water to the level of the cap 12.

Tubes 15 and 16 are connected from ports on the cap 12 to ports on the cell top 13. Water is allowed to enter the membrane containing mixture M from the bottom up to saturate mixture M. Valve 20 on tubing 15 can be operated to vent air. Water is allowed to fill tubing 16 connected to a pair of pressurizable reservoirs of deaerated water. The pressure within the membranes (the "internal pressure") can be adjusted through tubing 16 connected to the pressurizable reservoir which is loaded with air pressure. The pressure in space surrounding the membranes (the "confining pressure") can be adjusted through tubing 14.

Figure 3:
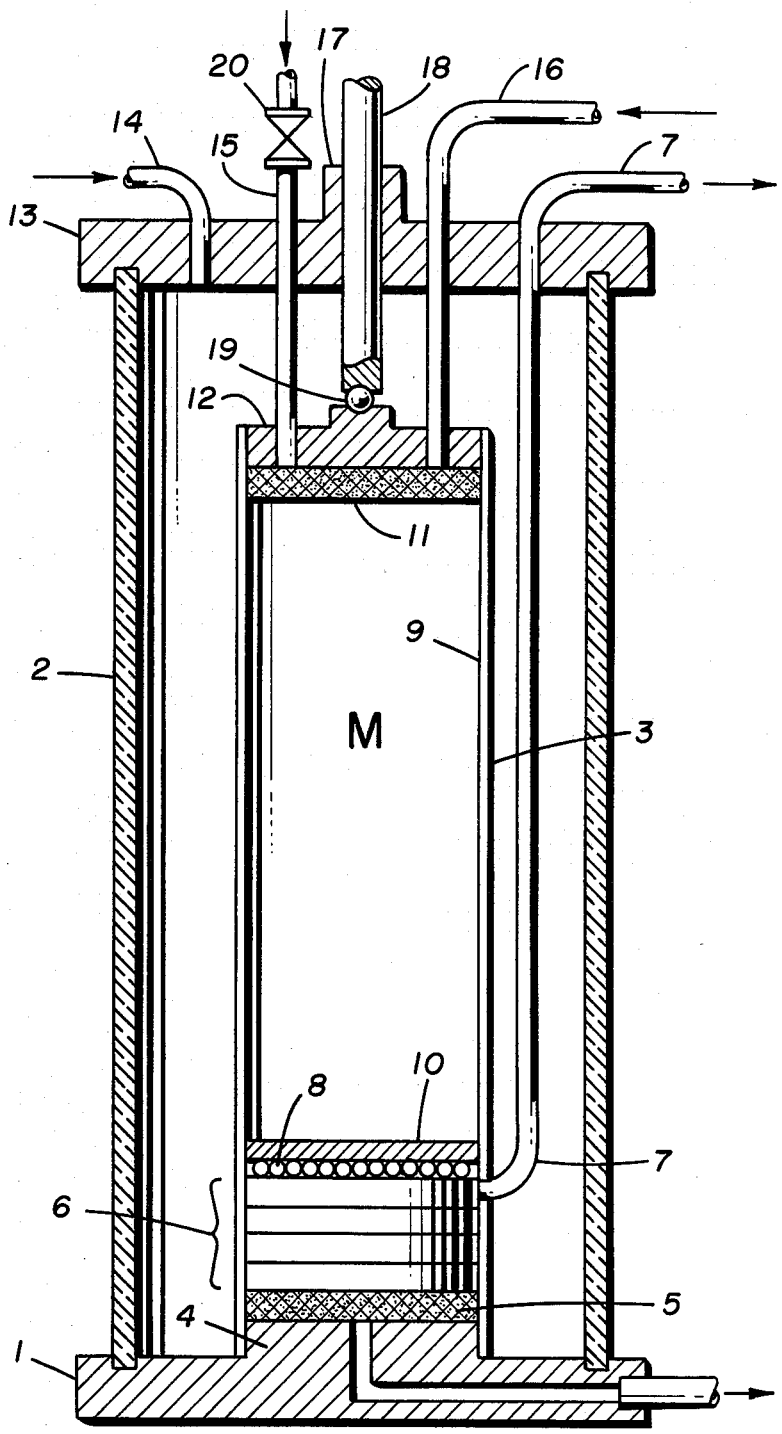
FIG. 3 is a sectional view of a triaxial cell apparatus useful in determining dynamic permeability.
Figure 4:
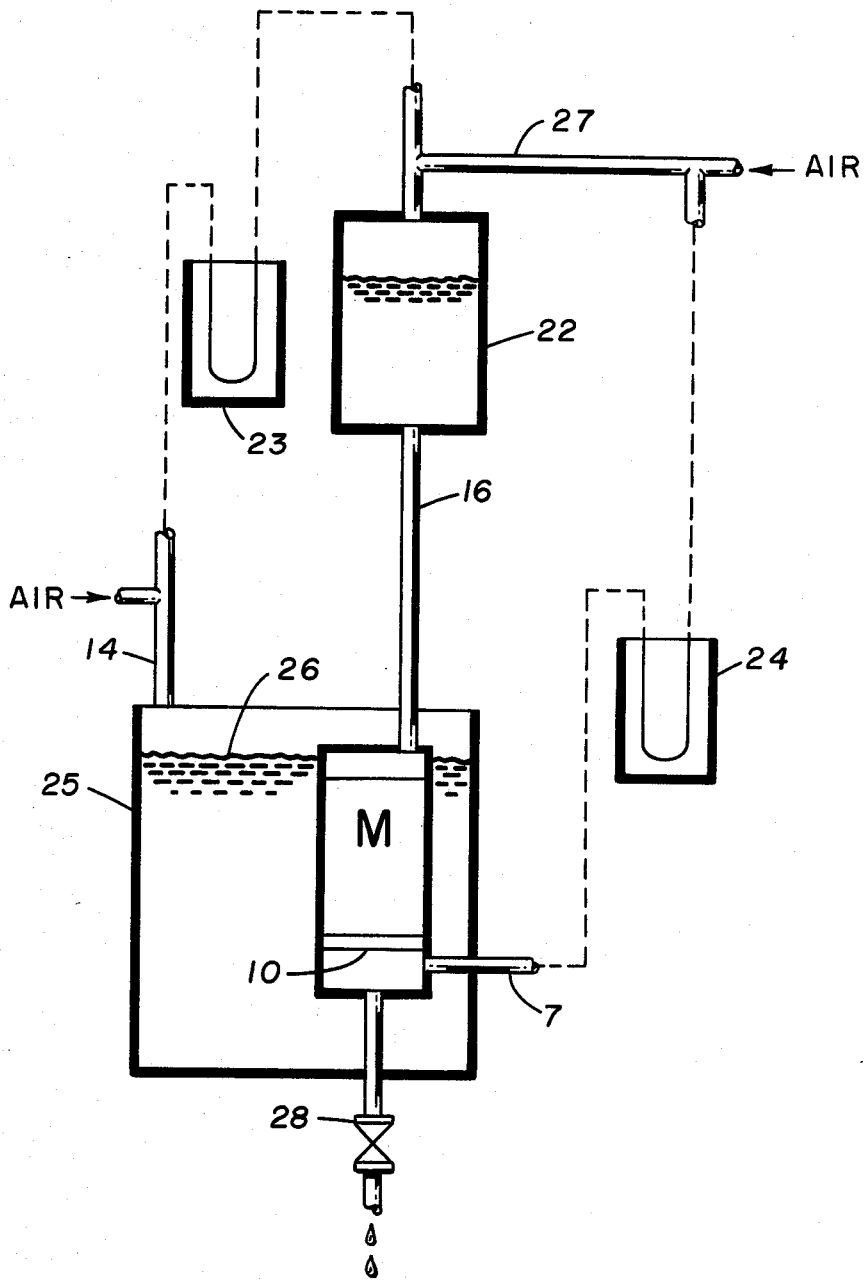
FIG. 4 is a schematic illustration of triaxial cell apparatus and ancillary equipment as used in determining dynamic permeability.

Refer now to FIG. 4 which is a simplified schematic illustration of the apparatus illustrated in FIG. 3 together with one of the pressurizable deaerated water reservoirs 22, mercury manometer 23 and water manometer 24. The pressurizable reservoir 22 is located above the triaxial cell 25, for instance a convenient distance between the average height of water in the reservoir and the level of water 26 in the triaxial cell 25 is 100 cm.

It is desirable to operate with the air pressure on the reservoir 22 at about 220 kN/m$^2$ (32 psi) while maintaining a "net confining pressure" of 12.1 kN/m$^2$ (1.75 psi). Net confining pressure, P, can be calculated from the following equation:

$$P=1.33\ (H-HW/13.6),$$

where

P is the net confining pressure, expressed in terms of kN/m$^2$;

H is the pressure difference, measured by mercury manometer 23, of the excess air pressure at tubing 14 over air pressure at tubing 27; and HW is the average distance between the level of water in reservoir 22 and the level of water 26 in the triaxial cell 25.

For instance, when HW is about 100 cm, it is desirable to slowly increase the confining pressure measured at tubing 14 to at least 15 cm Hg (6 inches Hg) greater than the pressure at tubing 27. Then both pressures are slowly raised until the air pressure on the reservoir 22 is about 220 kN/m$^2$ (32 psig). The confining pressure should be adjusted such that the mercury manometer 23 indicates that the air pressure at tubing 14 is 16.5 cm Hg (6.5 inches Hg) greater than the air pressure at tubing 27. This should provide a net confining pressure of about 12.1 kN/m$^2$ (1.75 psi).

Flow is initiated by opening bleeder valve 28. The rate of flow is adjusted to generate a pressure drop measured at water manometer 24 in the range of 24 to 26 cm water (about 9.5 to 10.25 inches water). Readings of flow rate, time and water mamometer differential are recorded until permeability is stabilized, for instance usually 10 to 15 minutes. Axial loading via loading rod 18 is then started. An air actuated diaphragn air cylinder (not shown) is connected to the loading rod 18. A load pulse of 17.5 kN/m$^2$ (2.5 psi) is applied to the cap 12 and transmitted to mixture M at a frequency of once every two seconds (0.5 hertz). This loading simulates stress within the mixture M similar to subgrade stress from truck loading on a highway system.

Readings are taken after 1, 10, 100 and 500 loads and thereafter generally at six hour intervals.

Dynamic permeability of the engineering fabric is calculated from the following equation:

$$K=QL/HAT$$

where

K is dynamic permeability, expressed in terms of cm/sec;

Q is water flow volume, expressed in terms of cm$^3$, collected over time, T;

L is the height of soil mixture M, expressed in terms of cm;

H is the hydraulic gradient over the mixture as measured on water manometer 24, expressed in terms of cm;

A is the cross-sectional area of the fabric disc 10, expressed in terms of cm$^2$; and T is the time to collect a volume Q, expressed in terms of sec.

Figure 6:
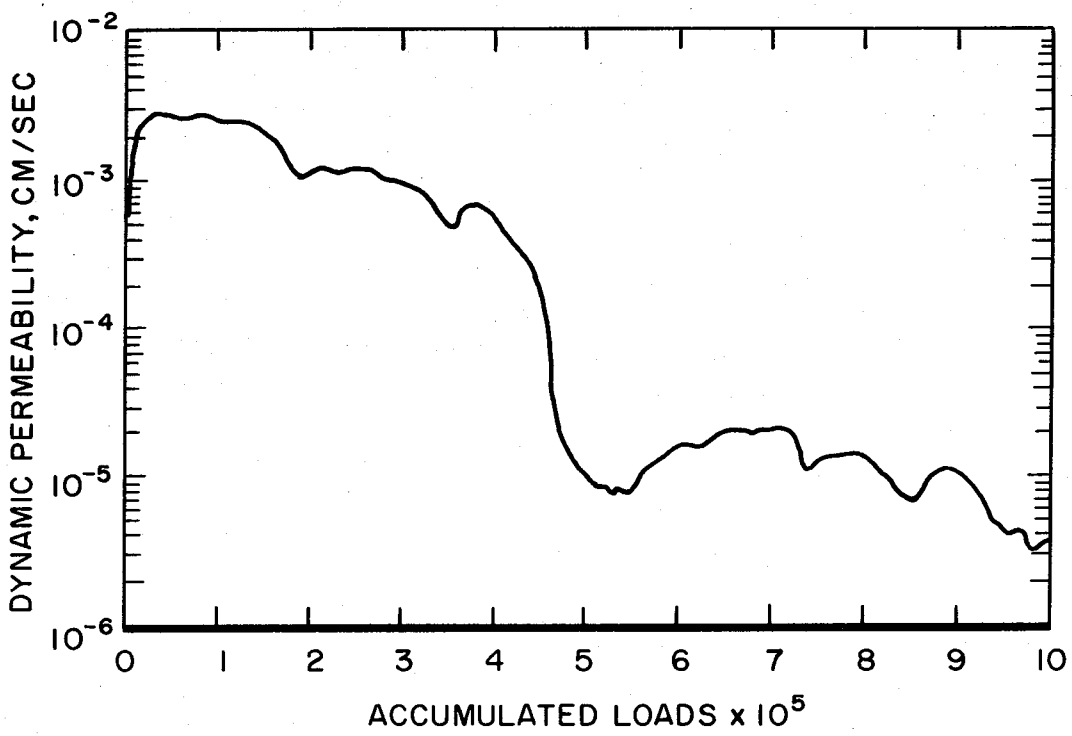
FIGS. 6, 7 and 8 are plots of dynamic permeability for accumulated loadings for various engineering fabrics.
Figure 7:
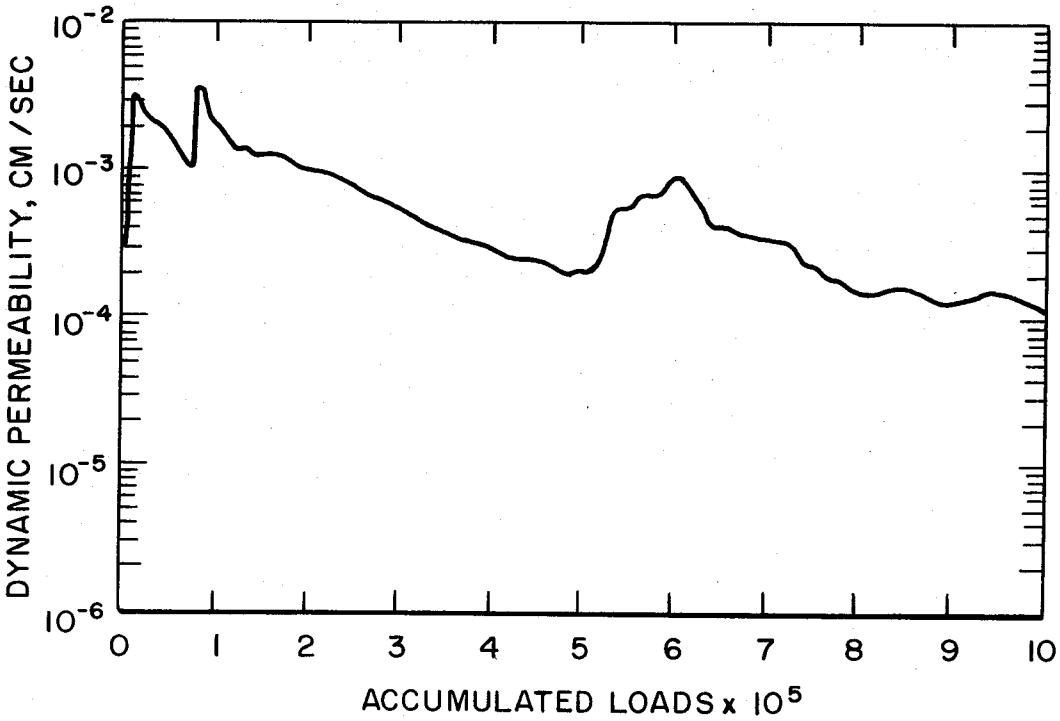
Figure 8:
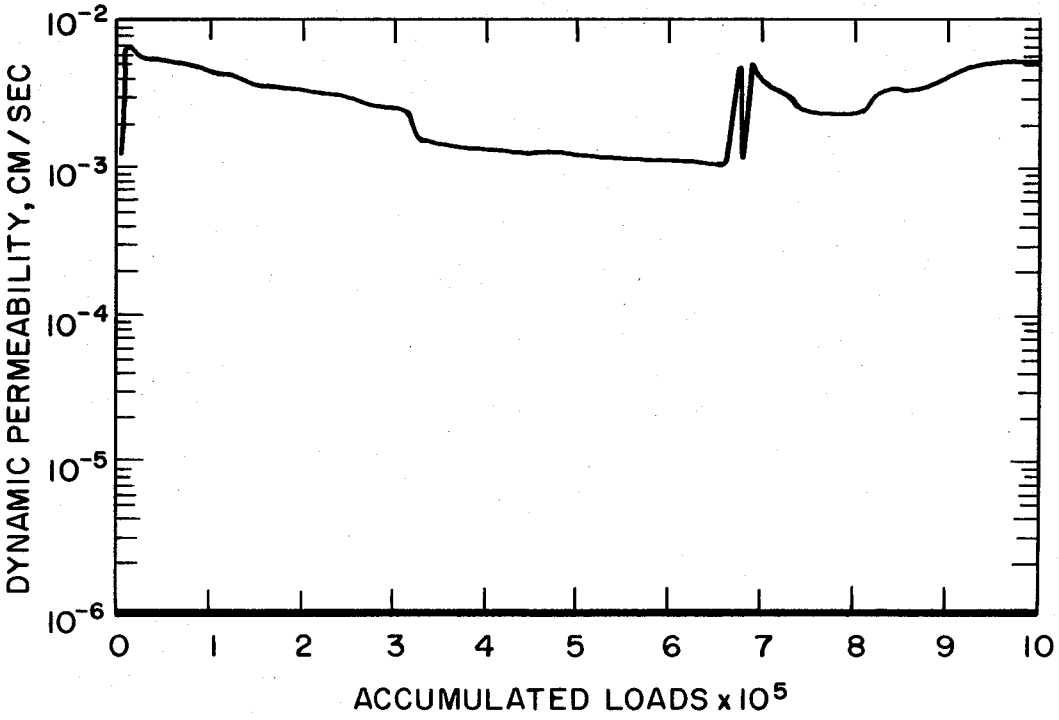

Dynamic permeability for the engineering fabrics identified in Example I is shown in FIGS. 6, 7, and 8, which are plots of dynamic permeability versus loadings.

FIG. 6 is a plot of dynamic permeability, recorded for Fabric No. 1, which decreases to less than $10^{-4}$ cm/sec after about 450,000 loadings.

FIG. 7 is a plot of dynamic permeability, recorded for Fabric No. 2, which decreases gradually but remains above $10^{-4}$ cm/sec even after one million loadings.

FIG. 8 is a plot of dynamic permeability, recorded for Fabric No. 3, which remains between $10^{-3}$ and $10^{-2}$ cm/sec over the application of one million loadings.

In view of the results of dynamic permeability analysis, Fabric No. 1 would be unacceptable for use with the drainage mat of this invention, while Fabric No. 2 and Fabric No. 3 would be acceptable for use with the drainage mat of this invention. Fabric No. 3 is exemplary of a more preferred fabric.

While the invention has been described herein with regard to certain specific embodiments, it is not so limited. It is to be understood that variations and modifications thereof may be made by those skilled in the art without departing from the spirit and scope of the invention.

What is claimed is:

1. A drainage mat comprising: a three-dimensional openwork covered on at least a major surface with a water permeable fabric having a permittivity from 0.2 seconds$^{-1}$ to 2.0 seconds$^{-1}$ and exhibiting a dynamic permeability after $10^6$ loadings of at least $10^{-4}$ centimeters per second, such that said mat is resistant to soil pluggage from pulsing water flow.

2. The drainage mat of claim 1 wherein said fabric has a permittivity from 0.5 seconds$^{-1}$ to 1.0 seconds$^{-1}$.

3. The drainage mat of claim 2 which after from 1 to $10^6$ loadings exhibits a dynamic permeability in the range of $10^{-4}$ to $10^{-2}$ centimeters per second.

4. The drainage mat of claim 2 wherein said three-dimensional openwork comprises a polymeric core having a plurality of fingers extending from a layer.

5. The drainage mat of claim 4 wherein the fingers are grass-like fingers.

6. The drainage mat of claim 5 wherein said fabric substantially envelops the core.

* * * * *